United States Patent [19]

Brandt

[11] 4,203,719

[45] May 20, 1980

[54] OIL BURNER ARRANGEMENT FOR HEATING INSTALLATIONS

[76] Inventor: Cary Brandt, Holderlinstrasse 11, 1 Berlin 19, Fed. Rep. of Germany

[21] Appl. No.: 879,877

[22] Filed: Feb. 22, 1978

[30] Foreign Application Priority Data

Mar. 21, 1977 [DE] Fed. Rep. of Germany ..... 2712856

[51] Int. Cl.[2] ..... F23D 15/02; F23Q 3/00; B05B 1/14

[52] U.S. Cl. ..... 431/352; 239/558; 431/195; 431/265; 431/347; 431/351

[58] Field of Search ..... 431/352, 351, 350, 195, 431/265, 347; 239/552, 558

[56] References Cited

U.S. PATENT DOCUMENTS

| | | | |
|---|---|---|---|
| 766,494 | 8/1904 | Crone | 239/558 |
| 3,218,134 | 11/1965 | Walsh | 431/352 |
| 3,597,137 | 8/1971 | Walker | 431/351 |
| 4,115,050 | 9/1978 | Gerwin | 431/352 |

FOREIGN PATENT DOCUMENTS

| | | | |
|---|---|---|---|
| 684834 | 4/1964 | Canada | 431/352 |
| 899040 | 6/1962 | United Kingdom | 431/352 |

*Primary Examiner*—James C. Yeung
*Assistant Examiner*—Daniel J. O'Connor
*Attorney, Agent, or Firm*—Basile and Weintraub

[57] ABSTRACT

An oil burner for heating installations is provided, having a burner housing comprising a perforated evaporating tube which is equipped with a circular series of blades to impart a twisting motion to the air and a cone-shaped guiding piece to impart an injection effect to the air, and which has attached thereto and maintained at a fixed distance therefrom a perforated, disk-shaped baffle. The present burner arrangement provides for a complete and soot-free, stoichiometric combustion wherein a blue flame is generated with extremely low level of noise.

10 Claims, 2 Drawing Figures

(A-B)

(A-B)

OIL BURNER ARRANGEMENT FOR HEATING INSTALLATIONS

BACKGROUND OF THE INVENTION

I. Field of the Invention

The present invention pertains to oil burners and, more particularly, the present invention pertains to an oil burner arrangement for heating installations which yield soot-free practically, stoichiometric combustion and which oil burner arrangement generates a blue flame.

II. Description of the Prior Art

Such oil burner arrangements are known in the art. They consist of a burner housing, into which air is introduced and in which the combustion takes place, and a nozzle located coaxially within the housing which serves for the atomizing of the oil which has been transferred to this point by means of a pump.

In order to achieve a substantially soot-free combustion with formation of a blue flame, it is known to install a baffle in the combustion area which is formed in the shape of a half sphere and which is equipped with openings and which is located coaxially with reference to the nozzle and at a distance therefrom, such that the outer surface of the baffle is facing the nozzle. The combustable mixture, comprising a mist of oil droplets and air, exits from the burner housing and hits the surface of the half sphere which is located in the combustion area and which is of sufficient temperature to gasify the oil and air mixture when it comes into contact therewith. Blue burning flames are generated at the periphery of the half sphere and at the edges of its openings, which blue flames result in an essentially soot-free combustion. A dependable gasification of the mist of fine oil droplets which contact the surface of the half sphere is favored by the fact that a pressure lower than atmospheric pressure is generated in the inside of the half sphere due to the hitting of the oil and air mixture. Because of this lower pressure, the flames are sucked back into the openings and, in this way, enhance the gasification of the arriving mists of fine oil droplets. The disadvantage of this known version rests in the fact that it is difficult to adjust the half sphere shaped baffle in the combustion area with reference to the nozzle, as a soot-free combustion can only be achieved if the exact, predetermined distance between the baffle and the nozzle is maintained. In addition, the size and the location of the baffle is dependent on the capacity of the furnace, and furthermore the function of this arrangement can be disturbed by draft. Furthermore, different versions of burners are necessary for different capacities. Therefore, serious difficulties are inherent in the use of this known construction with regard to the manufacture and the necessary adjustment and the maintenance.

Furthermore, a version is known where a cylindrical burner is used which is located adjacent to the burner housing, positioned coaxially with reference thereto and extending into the combustion area. This burner comprises a cylinder which is closed at its periphery. Experience has shown that pulsations can occur when the known cylindrical burner is used, resulting in an unstable flame which will move back and forth in the tube. In addition, the cylindrical burner has only narrowly limited application.

III. Prior Art Statement

In the opinion of applicant, the aforementioned prior art constitutes the most relevant art of which applicant is aware.

SUMMARY OF THE INVENTION

In accordance with the present invention, a burner of the cylindrical variety is arranged in such a way that a soot-free, stoichiometric combustion is guaranteed and that an easy and simple adaption with regard to different burning capacities can be achieved by a simple exchange of an evaporator tube without having to apply a great effort towards the assembly of the construction and without the necessity of a precise and exact adjustment. In accordance with the invention, the evaporating tube or gasifier tube is equipped at its periphery with drilled holes which serve to permit the introduction of air from the combustion area and the evaporator tube is equipped with a baffle in the shape of a disk, which baffle is connected at a distance to the opened end of the evaporator tube by means of cross pieces in a direction perpendicular to the axis of the evaporator tube, and which disk-shaped baffle is equipped with drilled holes which serve for the combustion of the oil and air mixture which exits from the evaporator tube.

The invention is furthermore characterized by the fact that the nozzle is shaped in the form of a hollow cone.

Furthermore, the invention consists of an outward flanging of the edges of the openings of the baffle.

The invention is furthermore characterized by the fact that the evaporator tube is constructed without drilled holes in the area which encompasses the burner nozzle and which evaporator tube is equipped at its inner wall with a circular series of blades which imparts a twisting motion to the air which was added for the combustion and adjacent to which circular series of blades there is a guiding piece which is tapered in the fashion of an obtuse cone, and which guiding piece imparts an injection effect on the air which is used for the combustion, and which guiding piece protrudes with reference to the burner nozzle.

Other objects, advantages and applications of the present invention will be readily appreciated as the same becomes better understood by reference to the following detailed description, when considered in connection with the accompanying drawing, wherein like reference characters refer to like parts throughout the several views in which:

DESCRIPTION OF THE PREFERRED EMBODIMENT

Figure 2:
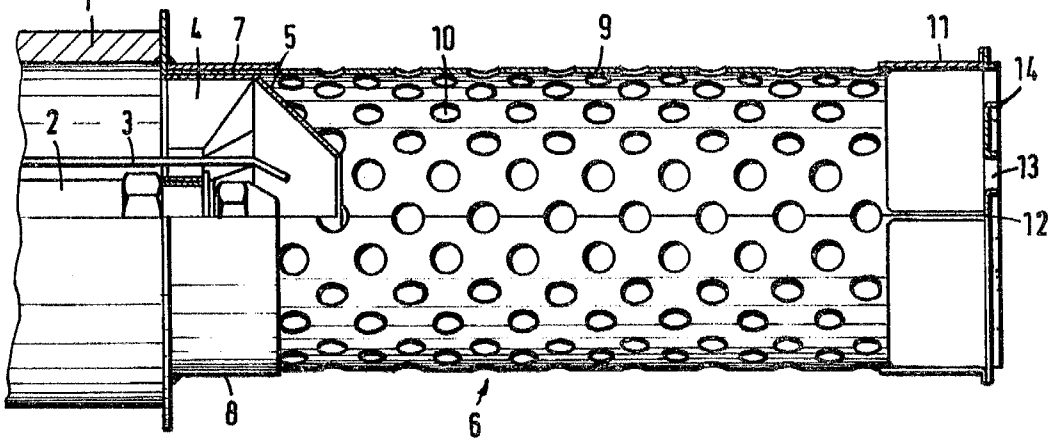
FIG. 2 is a cross-sectional view of the present invention, taken along Line A-B of FIG. 1.
Figure 1:
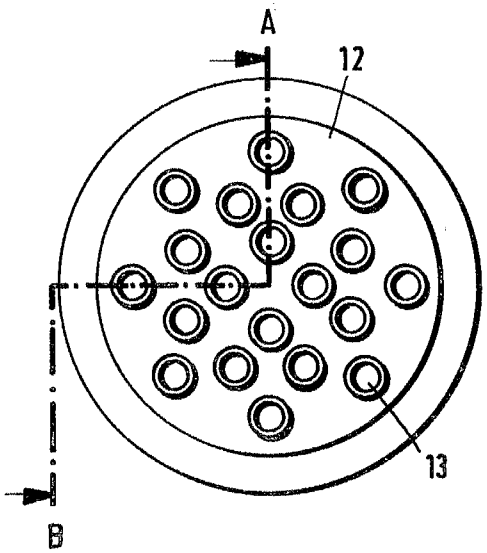
FIG. 1 is an end elevational view of the baffle of the present invention.

A burner housing, shown at 1, is depicted in FIG. 2 as having a nozzle 2 which is disposed coaxially thereto. The nozzle 2 is equipped with an ignition bar 3 and is surrounded by a circular series of blades 4. A guiding piece 5 is provided within an evaporator tube 6 which is disposed within the burner housing 1. The evaporator tube 6 is equipped with an attachment part 7 which is adapted to fittingly engage with a cylindrical, protruding collar 8 provided on the burner housing 1.

The evaporator tube 6 is provided with a cylindrical surface area 9 over which is disposed a plurality of perforations 10. The diameter of the perforations or drilled holes is one tenth or less the diameter of the tube.

It should be noted that the circular series of blades 4 is located within the circular, protruding collar 8. It is then provided that the protruding collar 8 serves as a receptor for the blades 4, the guiding piece 5 and the evaporator tube 6 by means of the attachment part 7.

The evaporator tube 6 is open at its outer end opposite the collar 8 and is provided with a plurality of cross pieces 11 along its circumference by which means a baffle 12 is affixed thereto. Thus the baffle 12 is attached to the tube 6 and is maintained at a fixed distance therefrom.

The baffle 12 is disk-shaped and is provided with a plurality of circular, concentrically disposed rows of holes 13. The holes of one circle offset with reference to the holes of the adjacent circle. Preferably, the edges 14 of the holes 13 are flanged, the flanges extending outwardly therefrom.

By means of the drilled holes 10 which are located on the evaporator tube 6, a controlled addition of air from the burner space to the oil which is pumped into the evaporator tube by conventional methods is achieved. In this way an optimum evaporation of the oil is warranted because the air entering through the openings has been heated to a high temperature by contact with the baffle 12. The oil cannot settle at the walls of the evaporator tube 6, and the turbulence in the tube is less as compared with a closed evaporator tube due to the openings 10 which are located thereon, (in the case of a closed evaporator tube, for instance, the air for the combustion and burning space enters only from the rear) in such a way that a flame is not generated in the evaporator tube. Due to the burning space air which enters the inner tube via the openings, and which air possesses a temperature of approximately 650 degrees centigrade. The oil evaporates completely whereas the combustion air, which has been added from the burner housing, remains relatively cool at a temperature of approximately 200 degrees centigrade. The combustion of the evaporated oil takes place exclusively at the disk-shaped baffle whereas the rapid evaporator tube proper remains free of any flames. The use of a hollow cone nozzle 2 is especially advantageous. In this way the most favorable degree of evaporation can be achieved since there is hardly any oil in the center of the cone which has been generated by the hollow stream nozzle. A stable flame is achieved by means of the edges 14 of the openings of the disk-shaped baffle, which edges have been flanged towards the outside. Due to the combined action of the circular series of blades 4, which is known, and the guiding pieces which serve to increase the velocity, an optimum injection effect and, thus, an optimum evaporation of the oil are achieved. The part of the evaporator tube equipped with holes correspond to double the tube diameter. Due to the dimensions of the length and the diameter and the holes of the evaporator tube 6 according to the invention, it is assured that the oil and air mixture which should be burned can only come in contact with the evaporator tube 6 in the area of the end of the evaporator tube 6 in such a way that a contact of the oil with the inner wall of the evaporator tube 6 is not possible. In order to achieve an optimum degree of effectiveness, it is important that the total area of the drilled holes of the evaporator tube should amount, at most, to one-fourth of the peripheral area of the evaporator tube 6. It is also advantageous for the achievement of an optimum combustion that the distance between the disk-shaped baffle and the end of the evaporator tube corresponds to one-sixth of its length which has been equipped with drilled holes.

It is a special advantage of the oil burner arrangement according to the invention that it is adaptable to different burning capacities in the simple way by changing the diameter of the hole of the guiding piece and by changing the amount of oil per unit of time. This necessary adaptation can be achieved in a simple way by removing the evaporator tube from the burner housing and by reattaching the evaporator tube after a new guiding piece has been introduced. In addition, the burner arrangement is characterized by an extremely low level of noise during the operation.

While only one example of the present invention has been disclosed, it should be understood by those skilled in the art of oil burner arrangements that other forms of the present invention may be had, all coming within the spirit of the invention and scope of the appended claims.

What is claimed is as follows:

1. An oil burner arrangement for heating installations which generates a blue flame and which serves for the achievement of a soot-free, stoichiometric combustion, which oil burner arrangement comprises a burner housing, which burner housing serves for the addition of combustion air; a nozzle which is located coaxially in the burner housing, said nozzle serving to atomize oil; means for communicating oil to said nozzle; an evaporator tube which is located adjacent to the burner housing and located coaxially with reference to the burner housing, said evaporator tube extending into the burner space, said evaporator tube having at its circumference a plurality of drilled holes, which drilled holes serve for the addition of air from the burner space; a disk-shaped baffle, said evaporator tube being equipped with said disk-shaped baffle, said disk-shaped baffle being located at a selected distance with respect to the opened end of the evaporator tube cross pieces for mounting said baffle to said tube open end; said disk-shaped baffle being directed perpendicular to the axis of the evaporator tube, said disk-shaped baffle being equipped with outward flanged holes, and whereby the outward flanged holes holes serve for the stable combustion of the oil and air mixture which emerges from the evaporator tube.

2. The oil burner arrangement as defined in claim 1 wherein said nozzle is a hollow cone nozzle.

3. The oil burner arrangement as defined in claim 1 wherein the evaporator tube is constructed without drilled holes in the area which is adjacent to the burner housing and which encompasses the burner nozzle; and a circular series of blades; said evaporator tube being equipped with said circular series of blades, which series of blades is attached to the inner wall of the evaporator tube and which circular series of blades impart a twisting motion to the added combustion air and adjacent to which circular series of blades there is a guiding piece, which guiding piece is tapered in the fashion of an obtuse cone, and which guiding piece imparts an injection effect to the combustion air, and which guiding piece protrudes with reference to the burner nozzle.

4. The oil burner arrangement defined in claim 1 wherein the evaporator tube is dimensioned with regard to its diameter and its length in such a way that the oil and air mixture which should be burned comes into contact with the evaporator tube only in the area of the end of the evaporator tube.

5. The oil burner arrangement defined in claim 1 wherein the length of the part of the evaporator tube which is equipped with drilled holes corresponds to double the diameter of the tube.

6. The oil burner arrangement defined in claim 1 wherein the total area of the drilled holes of the evaporator tube amounts to approximately one-quarter of its peripheral area.

7. The oil burner arrangement defined in claim 1 wherein the distance between the disk-shaped baffle and the end of the evaporator tube corresponds to one-sixth of its length which has been equipped with drilled holes.

8. The oil burner arrangement defined in claim 1 wherein the drilled holes of the disk-shaped baffle are located on circles, which circles are located concentric to the center of the disk-shaped baffle and wherein the drilled holes of one circle are always offset with reference to the drilled holes of the adjacent circle.

9. The oil burner arrangement defined in claim 1 wherein the diameter of the individual drilled holes of the evaporator tube are small with reference to the diameter of the tube and amount to one-tenth or less.

10. The oil burner arrangement defined in claim 3 whereas a protrusion in the form of a ring-shaped cylinder is located at the oil burner housing which serves for reception of that part of the evaporator tube which is not equipped with openings.

* * * * *